US007064771B1

(12) United States Patent
Jouppi et al.

(10) Patent No.: US 7,064,771 B1
(45) Date of Patent: Jun. 20, 2006

(54) METHOD AND APPARATUS FOR COMPOSITING COLORS OF IMAGES USING PIXEL FRAGMENTS WITH Z AND Z GRADIENT PARAMETERS

(75) Inventors: Norman P. Jouppi, Palo Alto, CA (US); Chun-Fa Chang, Durham, NC (US)

(73) Assignee: COMPAQ Information Technologies Group, L.P., Houston, TX (US)

( * ) Notice: Subject to any disclaimer, the term of this patent is extended or adjusted under 35 U.S.C. 154(b) by 0 days.

(21) Appl. No.: 09/301,257

(22) Filed: Apr. 28, 1999

(51) Int. Cl.
*G09G 5/36* (2006.01)

(52) U.S. Cl. ..... 345/614; 345/506; 345/592

(58) Field of Classification Search ..... 345/581, 345/592, 611, 612, 613, 614, 501, 503, 506, 345/545, 561
See application file for complete search history.

(56) References Cited

U.S. PATENT DOCUMENTS

| | | | | | |
|---|---|---|---|---|---|
| 5,929,862 | A | * | 7/1999 | Barkans | 345/431 |
| 5,943,060 | A | * | 8/1999 | Cosman et al. | 345/432 |
| 5,990,904 | A | * | 11/1999 | Griffin | 345/435 |
| 6,072,500 | A | * | 6/2000 | Foran et al. | 345/431 |
| 6,104,407 | A | * | 8/2000 | Aleksic et al. | 345/428 |
| 6,115,049 | A | * | 9/2000 | Winner et al. | 345/432 |
| 6,128,000 | A | * | 10/2000 | Jouppi et al. | 345/136 |

OTHER PUBLICATIONS

Kurt Akeley, *RealityEngine Graphics*. In Computer Graphics Annual Conference Series (Proceedings of SIGGRAPH 93), pp. 109–116, Aug. 1993.

Loren Carpenter. *The A–buffer*, an antialiased hidden surface method. In Computer Graphics Annual Conference Series (Proceedings of SIGGRAPH 84), vol. 18, pp. 103–108, Jul. 1984.

J.C. Chauvin. *An Advanced Z–Buffer Technology*. In Proceedings of the IMAGE VII Coference, pp. 77–85, Tucson, Jun. 1994.

Montrym et al. InfiniteReality: *A Real–Time Graphics System*. In Computer Graphics Annual Conference Series (Proceedings of SIGGRAPH 97), pp. 293–302, Aug. 1997.

Andreas Schilling and Wolfgang StraBer. EXACT: Algorithm and hardware architecture for an improved A–Buffer. In Computer Graphics Annual Conference Series (Proceedings of SIGGRAPH 93), vol. 27, pp. 85–92, Aug. 1993.

Winner et al. *Hardware accelerated rendering of antialiasing using a modified A–buffer algorithm*. In Computer Graphics Series (Proceedings of SIGGRAPH 97), pp. 307–316, Los Angeles, California, Aug. 1997.

* cited by examiner

*Primary Examiner*—Ulka J. Chauhan
(74) *Attorney, Agent, or Firm*—Pennie & Edmonds LLP

(57) ABSTRACT

A graphics data processing apparatus includes a graphics memory having pixel storage for storing up to a predetermined number of fragment values for the pixel. Each stored fragment value is associated with a fragment of an image that is visible in that pixel. When a new fragment is determined to be visible in the pixel, but all the available fragment values for the pixel are already in use, one of the previously stored fragment values is either replaced by, or combined with the fragment value for the new fragment. The resulting new fragment value is used to determine the color of the pixel. Alternately, if the new fragment is determined to be totally occluded by one or more of the other fragments, the new fragment may be discarded. Z-depth and Z gradient information is stored each fragment. This Z information is used to determine the relative depth values of the fragments, which in turn is used to determine which fragment to discard or to combine with another fragment when all the available fragment values for a pixel are already in use.

20 Claims, 10 Drawing Sheets

METHOD AND APPARATUS FOR COMPOSITING COLORS OF IMAGES USING PIXEL FRAGMENTS WITH Z AND Z GRADIENT PARAMETERS

This invention relates generally to computer graphics, and more particularly to a method and apparatus for producing composite colors images defined by subpixel resolution.

BACKGROUND

Many computer graphics systems use pixels to define images. The pixels are arranged on a display screen as an rectangular array of points. Aliasing occurs because the pixels have a discrete nature. Artifacts can appear when an entire pixel is given a light intensity or color based upon an insufficient sample of points within that pixel. To reduce aliasing effects in images, the pixels can be sampled at subpixel locations within the pixel. Each of the subpixel sample locations contributes color data that can be used to generate the composite color of that pixel. However, some graphics systems may limit the amount of memory for storing subsample color data for each pixel. Thus, such graphic systems must carefully select which color data are stored so that these systems can still accurately produce a composite color for each pixel.

Uniform sampling is also known as supersampling, and is implemented in most high-end graphics devices. Supersampling requires large amounts of memory. For example, a conventional 1280×1024 framebuffer with 32-bit color and 32-bit depth uses 10 Megabytes (MB) of memory. But with 4×4 supersampling, more than 160 MB of memory are needed. Even worse, 4×4 supersampling would require about sixteen times the memory bandwidth of the convention framebuffer, or for a given memory bandwidth it would slow down rendering by a factor of around sixteen.

Careful examination of a supersampled pixel reveals that most of the color and depth values within a pixel differ little from each other. For example, if a pixel is completely covered by a surface, then most of the color and Z values are likely to be within a few percent of each other.

In software implementations of antialiasing, dynamic memory allocation can be used to vary the amount of storage used by each pixel. However, dynamic storage allocation is quite difficult and expensive to implement in hardware, and therefore a practical graphics processor must use the same amount of storage for every pixel. Since the amount of memory for each pixel is fixed, the representation of complex pixels (those with multiple surfaces of different colors) will be less accurate than in a system having more memory per pixel. The present invention uses Z gradient information to minimize errors in representing complex pixels using a small, fixed number of fragments.

SUMMARY OF THE INVENTION

A graphics data processing apparatus includes a graphics memory having pixel storage for storing up to a predetermined number of fragment values for the pixel. Each stored fragment value is associated with a fragment of an image that is visible in that pixel. When a new fragment is determined to be visible in the pixel, but all the available fragment values for the pixel are already in use, one of the previously stored fragment values is either replaced by, or combined with the fragment value for the new fragment. The resulting new fragment value is used to determine the color of the pixel. Alternately, if the new fragment is determined to be totally occluded by one or more of the other fragments, the new fragment may be discarded.

Z-depth and Z gradient information is stored each fragment. This Z. information is used to determine the relative depth values of the fragments, which in turn is used to determine which fragment to discard or to combine with another fragment when all the available fragment values for a pixel are already in use.

In a preferred embodiment, the graphics data processing apparatus includes a pipeline of circuits for processing the fragments values for a pixel. In particular, when a new fragment is added to the pixel, the corresponding fragment tuple is processed by the successive pipeline stages. A first pipeline stage determines if the new fragment is completely occluded by any other fragment of the pixel, or completely occludes any other fragment of the pixel. In such cases, the occluded fragment(s) are discarded, and there is no need to merge pixel fragments.

Otherwise, a next stage of the pipeline orders the new fragment tuple and the fragment tuples stored for the pixel so as to generate a sequence of fragment tuples ordered with respect to Z value.

A third stage of the pipeline determines, for each subpixel sample position, whether the fragments in the sequence of fragments are out of order with respect to Z value. In this stage, Z values are determined for two successive fragments in the sequence of fragment tuples at the subpixel sample positions covered by both of the two fragments, based on the center Z value and pair of Z gradient values for each of the two fragments. The determined Z values are compared, and a bit is set in a swap vector for each subpixel sample position at which the comparison result indicates that the fragments are out of order. A swap vector is generated for each pair of successive fragments in the pixel being processed. Using the swap vectors, a color value is generated for each subpixel sample position, using the color values at that position from every fragment in the pixel. The swap vectors are used so as to combine the color values in the correct order with respect to Z value, which is essential for proper determination of the color at each subpixel sample position. Then a color value is generated for the entire pixel by averaging the color values of at all the subpixel sample positions.

A fourth stage of the -pipeline merges two of the fragment tuples in the modified sequence of fragment tuples when the sequence of fragment tuples includes more fragment tuples than the pixel memory can store, so as to generate a merged fragment tuple that is then stored in the pixel memory.

BRIEF DESCRIPTION OF THE DRAWING

An embodiment of the invention will be described with reference to the accompanying drawings, in which.

DETAILED DESCRIPTION OF PREFERRED EMBODIMENTS

System Overview

Figure 1:
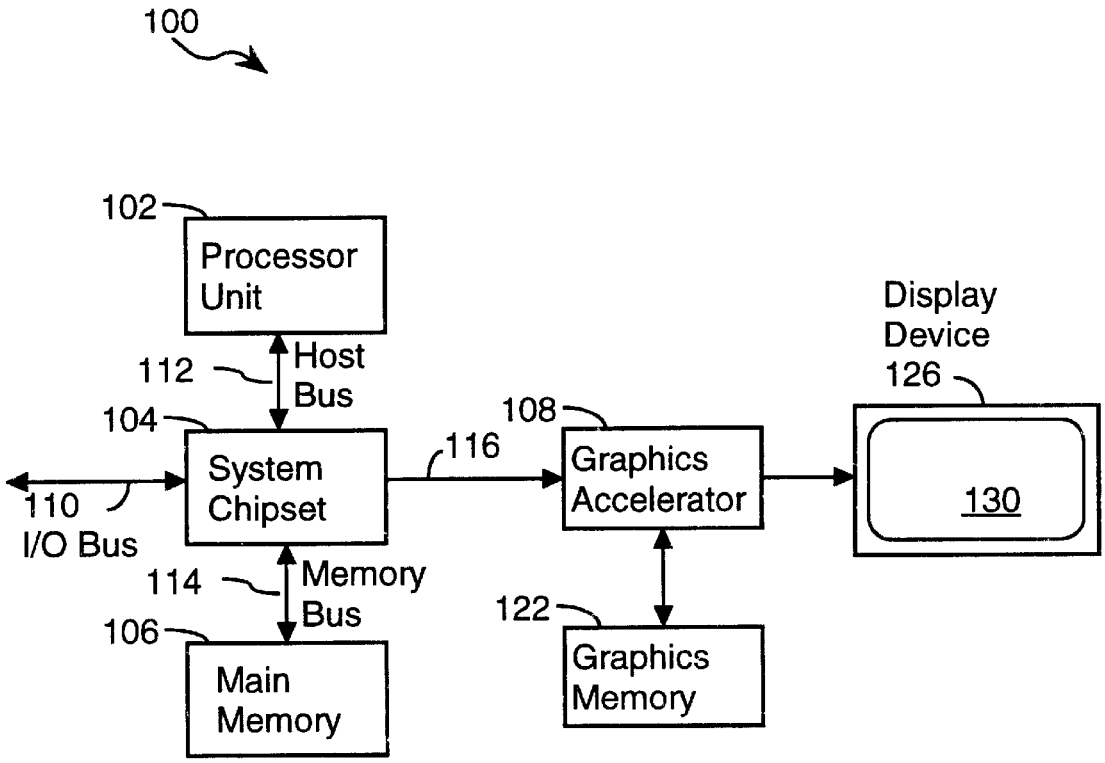
Prior Art FIG. 1
FIG. 1 is a block diagram of an exemplary computer graphics system that can be used to practice the invention.

FIG. 1 shows a computer system 100 that can generate monochrome or multicolor 2-dimensional (2D) and 3-dimensional (3D) graphic images for display according to the principles of the present invention. The computer system 100 can be any of a wide variety of data processing systems including, for example, a personal computer, a workstation, or a mainframe.

In the computer system 100, a system chipset 104 may provide an interface among a processing unit 102, a main memory 106, a graphics accelerator 108 and devices (not shown) on an I/O bus 110. The processing unit 102 is coupled to the system chipset 104 by the host bus 112 and includes one or more a central processing units (CPU's). The main memory 106 interfaces to the system chipset 104 by bus 114.

The graphics accelerator 108 is coupled to the system chipset 104 by a bus 116, by which the graphics accelerator 108 can receive graphics commands to render graphical images. A graphics memory 122 and a display device 126 are coupled to the graphics accelerator 108; the graphics memory 122 is coupled by bus 124, and the display device 126, by bus 127. The display device 126 preferably produces color images, but the invention can also be practiced with a monochrome monitor to display grayscale images or with printers that print black and white or color images.

An image appears on the display by illuminating a particular pattern of individual points called pixels. While the image rendered may be two dimensional (2D) or three dimensional (3D), the display device itself generally includes a two-dimensional array of pixels. The array size of display screens can vary widely. Examples of display screen sizes include 1024×768 and 1920×1200 pixels. For the purposes of practicing the invention, the display device 126 may be any suitable pixel-based display, such as a CRT (cathode ray tube), liquid-crystal display, laser printer, or ink-jet print.

The graphics memory 122 includes storage elements for storing an encoded version of the graphical image to be displayed. There is a direct correspondence between the storage elements and each pixel on the display screen 130. The storage elements are allocated to store data representing each pixel, hereafter referred to as pixel data. For example, five bytes may be used to encode a color representation for each pixel.

The values stored in the storage elements for a particular pixel controls the color of the particular pixel on the screen 130. The "color" of a pixel includes its brightness or intensity. There are many different ways of representing color information, including direct color value representations and indirect representations in which the stored pixel data are indices used to access a color lookup table. The present invention is applicable to systems using any pixel representation method.

During operation, the computer system 100 can issue graphics commands that request an object to be displayed. The graphics accelerator 108 executes the graphics commands, converting the object into primitives and then into fragments. A primitive is a graphical structure, such as a line, a triangle, a circle, or a surface patch of a solid shape, which can be used to build more complex structures. A fragment is a two-dimensional polygon created by clipping a primitive, such as a line, triangle, or circle, to the boundaries of the pixel. A more detailed. description of fragments is provided by Loren Carpenter in "The A-buffer, an Antialiased Hidden Surface Method", Computer Graphics Vol. 18, No. 3, 1984, pp. 103–107, incorporated by reference herein as background information.

The graphics accelerator 108 renders the fragments, and loads the pixel data corresponding to the fragments into the appropriate storage elements of the graphics memory 122. The pixel data can be transferred into the graphics memory 122 from the main memory 106 via busses 112, 114, 116, and 124, or written directly into the graphics memory 122 by the graphics accelerator 108.

To display the image, the pixel data are read out of the graphics memory 122 and rendered as illuminated points of color on the screen 130 of the display device 126.

Sparse Supersampling of Pixels

Figure 2A:
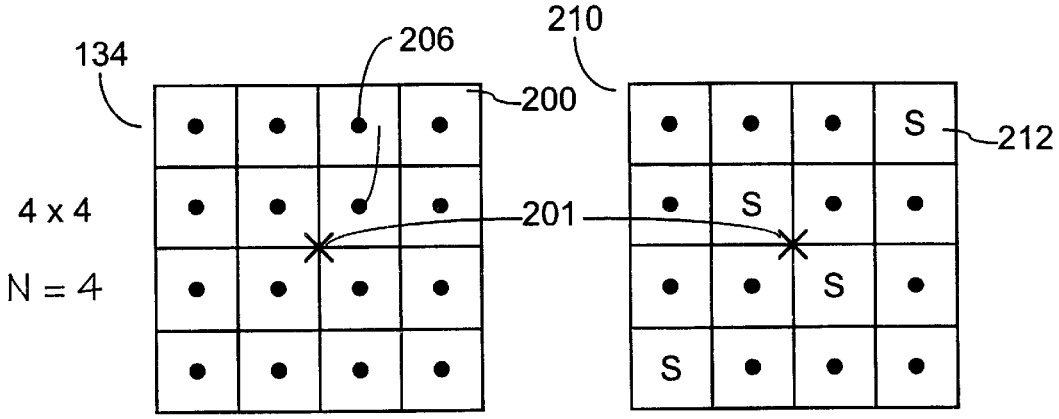
FIGS. 2A and 2B represent two subdivisions of a pixel into subpixels, and illustrate exemplary sparse supersampling patterns that can be used to sample the subpixels.
Figure 2B:
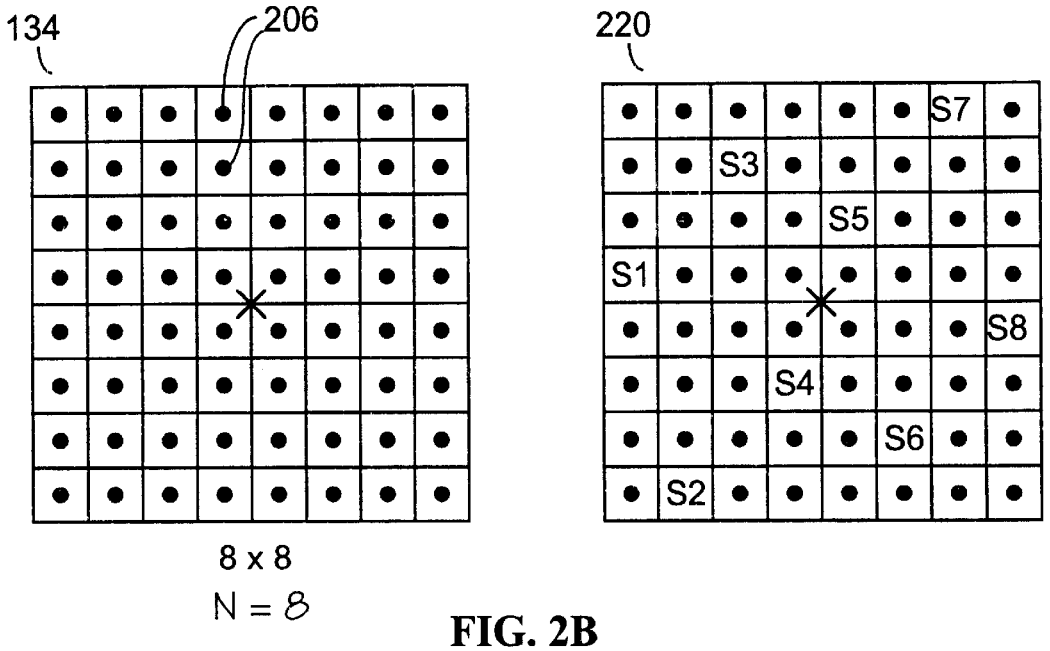

FIGS. 2A–2B illustrate two exemplary subdivisions of a pixel 134. FIG. 2A shows pixel 134 divided into a 4×4 array 200 of evenly spaced points called subpixels 206, while FIG. 2B shows an 8×8 array 202 of subpixels 206. Dividing a pixel 134 into subpixels 206 provides multiple points at which the image covering that pixel 134 can be sampled. For reference, the center 201 of the pixel 134 is indicated by an X.

Generally, the more subpixels 206 there are in the array, the greater the resolution of the pixel 134. Thus, the displayed color of the pixel 134 does not rely entirely on one sample point, but upon several subpixel samples 206. Methods for calculating a pixel value from multiple sample points are well known in the art. For example, the color of the pixel may be determined as the average of the colors of the subpixel samples.

Uniform sampling at every subpixel 206 in a pixel is known as supersampling. While, theoretically, supersampling presents opportunities for attaining high resolution, it unnecessarily consumes memory resources. Each sampled subpixel 206 requires memory resources to store and use the sampled data. Thus, fully sampling the 4×4 array 200 of subpixels 206 requires memory storage for sixteen samples. If the sixteen samples each required, for example, eight bytes of storage, then implementing full scene supersampling could require an additional 120 bytes per pixel compared to storing a single sample per pixel. For a 1920×1200 pixel display, the amount of extra memory required to store sixteen samples instead of one is about 295 MBytes.

Accordingly, to conserve memory and bus bandwidth resources, sparse supersampling is used. When using sparse supersampling, the subpixels that are samples are sparsely distributed in the subpixel array. In general, the antialiasing results of using spare supersampling are almost as effective as for full supersampling.

FIGS. 2A and 2B each illustrate exemplary sparse supersampling patterns 210, 220 that can be used to sample the subpixels 206 of 4×4 and 16×16 subpixel arrays, respectively. The illustrated exemplary sample patterns 210, 220 each have N samples distributed uniformly throughout an N×N subpixel array with exactly one subpixel sample in any particular row and in any particular column.

The sampling pattern 210 has four subpixels samples S1–S4 (N equals 4). For sampling pattern 220, N equals 8, and the eight subpixel samples are denoted as S1–S8. The sampling pattern 210, 220 is typically repeated for every pixel 134 on the display screen 130. Various other sampling patterns can be used to practice the principles of the invention.

Although sparse supersampling uses less memory than full scene supersampling, considerable amounts of additional memory are still required. For example, when N equals 4 (i.e, four subsamples are used for each pixel), a 1920×1200 pixel screen 130 still needs eight bytes storage for each of four subpixel samples. The three extra subsamples require an additional 55 Mbytes of pixel data storage (i.e., storing one frame requires about 74 Mbytes instead of about 18 Mbytes). The memory requirements for storing an image are doubled and quadrupled when N equals 8 and 16, respectively.

The present invention can reduce the storage requirements even more than such sparse supersampling, without reducing the number of subpixel samples for an N×N subpixel array. In particular, the present invention represents each pixel using M fragment values, where M is less than N, the number of subpixel samples.

Pixel Subsample Data Storage

Figure 3:
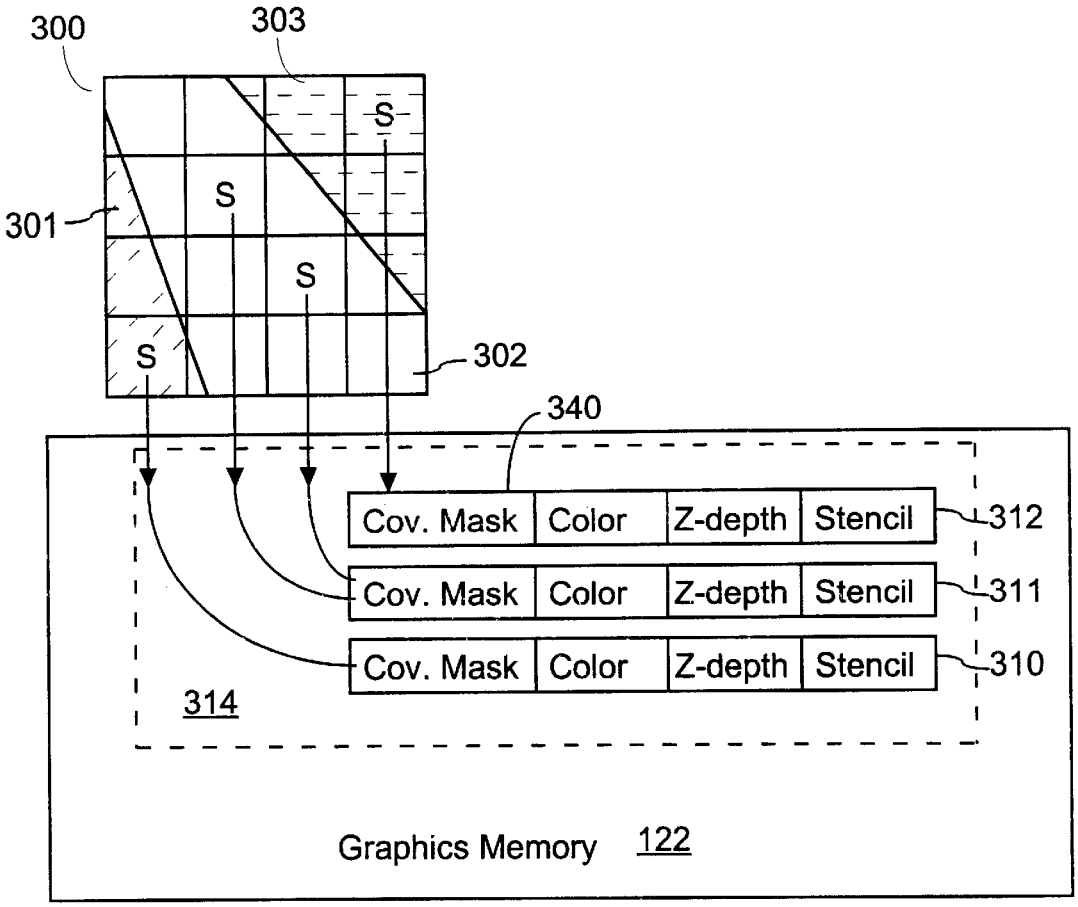
FIG. 3 illustrates data structures stored in a pixel memory represent a plurality of fragment tuples.

FIG. 3 shows an exemplary pixel 300 that is part of an image and is subdivided into a 4×4 subpixel array 200. The pixel 300 has four sampling positions according to sampling pattern 210 of FIG. 2A. Pixel 300 is covered by three image fragments 301, 302, 303. Each fragment 301, 302, 303 is associated with a fragment value, sometimes called a "fragment triple" or "fragment tuple" 310, 311, 312. For example, in FIG. 3, fragment tuple 310 is associated with fragment 301, fragment tuple 311 is associated with fragment 302 and fragment tuple 312 is associated with fragment 303.

Each fragment value includes a color value 304, a Z-depth value 306, and a stencil value 308. The color value 304 represents the color and opacity of the corresponding fragment. The Z-depth value 306 represents a Z-coordinate value of the corresponding fragment along a Z-axis that is perpendicular to the image. The Z-coordinate is used to provide 3D depth. The stencil value 308 can be used to group or identify sets of fragments of the image 132, or to logically or arithmetically process or count operations upon fragments, or for other purposes known to those skilled in the art.

In the preferred embodiment, each fragment tuple uses five bytes of memory to represent the color 304, three bytes for the Z-depth 306 and one byte for the stencil 308. The five-byte color 304 field is used to store four 10-bit color parameters: Red, Green, Blue, and Alpha. These parameters are sometimes called "channels." The value stored in each RGB (Red, Green, Blue) channel indicates the intensity (or brightness) of that color channel. Low values correspond to low intensity, dark colors; high values correspond to high intensity, light colors. Various methods for producing the color combining the RGB values are well known in the art.

The opacity of the fragment is expressed by the value stored in the Alpha channel. For example, a 1.0 value (i.e., all 10 Alpha-channel bits are 1) indicates that the associated fragment is opaque, a 0.0 value indicates that the fragment is invisible, i.e., completely transparent, and values between 0.0 and 1.0 indicate degrees of transparency.

Memory is allocated to each pixel 134 for storing a predetermined number of fragment values. This memory can be either graphics memory 122, as shown in FIG. 3, or main memory 106. Conceivably, a group of pixels, like a 2×2 array of pixels can share a particular pixel memory 314. Any fragment triples stored in the pixel memory 314 would be used by each pixel in the group, rather than by only one particular pixel 300. This can save more memory than storing a predetermined number of fragments for every pixel, particularly for portions of the image 132 that change color and Z-depth gradually.

Alternatively, memory for storing fragment triples can be dynamically allocated to each pixel 134 rather than fixed to a predetermined number. Here, a variable number of fragment triples can be stored for each pixel 134, the graphics accelerator 108 allocating memory to the pixel 134 as needed, presuming there is still available pixel memory in the system 100. Another method combines aspects of both above-described methods, allocating memory to each pixel 134 for storing a predetermined number of fragment triples, and dynamically allocating additional memory to a particular pixel 134 when needed to store a fragment triple beyond the predetermined number.

The exemplary embodiment shown in FIG. 3 stores three fragment tuples 310, 311, 312 in the pixel memory 314. These fragment tuples 310, 311, 312 are associated with the fragments 301, 302, 303 that cover the pixel 300. The pixel memory 314 for an "empty" pixel may be initialized to contain a default fragment value. The default fragment value represents a background color used when no fragments cover a particular subpixel sample or when all fragments that cover the particular subpixel sample are transparent.

In other embodiments, each pixel memory 314 can store fewer or more than three fragment tuples in order to lower or improve quality of the antialiasing. Storing fewer fragment values per pixel saves memory, but can produce lesser quality antialiasing than storing many fragment values per pixel. For instance, it is observed that for the 8×8 subpixel array 202 and the sampling pattern 220 (N=8), storing three fragment values produces better antialiasing results than storing two fragment values.

As shown in FIG. 3, each fragment tuple can include a coverage mask 340, with each bit of the mask indicating whether or not the fragment value applies to a corresponding one of the subpixel samples. Thus a fragment value with a coverage mask value of "1 0 0 0" corresponds to a fragment covering only subpixel S1, while a coverage mask value of "0 1 1 1" would indicate that the fragment value corresponds to a fragment covering subpixels S2, S3 and S4. In some embodiments, the stencil field of each fragment value includes the coverage mask 340 for that fragment value.

When rendering images having transparent or partially transparent fragments, the fragments for a pixel may have overlapping coverage masks. In FIG. 3, if fragment 302 were transparent, it might have a coverage mask of "0 1 1 1" while fragment 303 might have a coverage mask of"0 0 0 1"—indicating that both fragment 302 and 303 cover subpixel S4.

When rendering an image, the graphics accelerator 108 determines which fragments are visible at each subpixel sample. A fragment covers a subpixel when the center of the subpixel sample is within an area enclosed by the fragment or, in certain cases, on an edge of the fragment. For subpixels covered by more than one fragment, this determination is based on which fragment has the lowest Z depth at the subpixel, as well as the opacity of the fragments covering the subpixel. The fragments with the lowest Z-depth (and thus are closest to the viewer) are referred to as foreground fragments. Fragments with higher Z-depth values, which are further from the viewer, are referred to as background fragments. An opaque foreground fragment can occlude a background fragment behind that foreground fragment.

Accordingly, each fragment must pass a Z-depth test at one of the subpixel samples S1–S4, that is, the Z-value 306 of the fragment triple associated with that fragment must be smaller, i.e., closer from the perspective of the viewer, than the Z-value 306 for every other opaque fragment covering the same subpixel sample. If a fragment passes the Z-depth test, then the graphics accelerator 108 stores the fragment tuple associated with the visible fragment in the pixel memory 314.

Using the pixel memory data structure shown in FIG. 3, only two or three fragment tuples are stored for each pixel, because each fragment tuple can be linked (or mapped) to multiple subpixel samples. This reduces memory storage requirements compared to storing four fragment tuples in the pixel memory 314, one for each of the four subpixel samples S1–S4. The memory savings (from using a data structure that enables mapping multiple subpixel samples to each fragment tuple) increase substantially when each pixel is supersampled using a larger subpixel array, such as sampling pattern 220 (having eight subpixel. samples) for an 8×8 subpixel array 202 (shown FIG. 2A), or a sampling pattern of sixteen subpixel sampling for a 16×16 subpixel array.

The displayed color of the pixel 300 depends upon the filtering function used to combine the fragment tuples associated with the subpixel samples S1–S4. One filter function is simply to average the colors of the fragment triples associated with the four subpixels samples S1–S4.

Merging Pixel Fragments

Figure 4A:
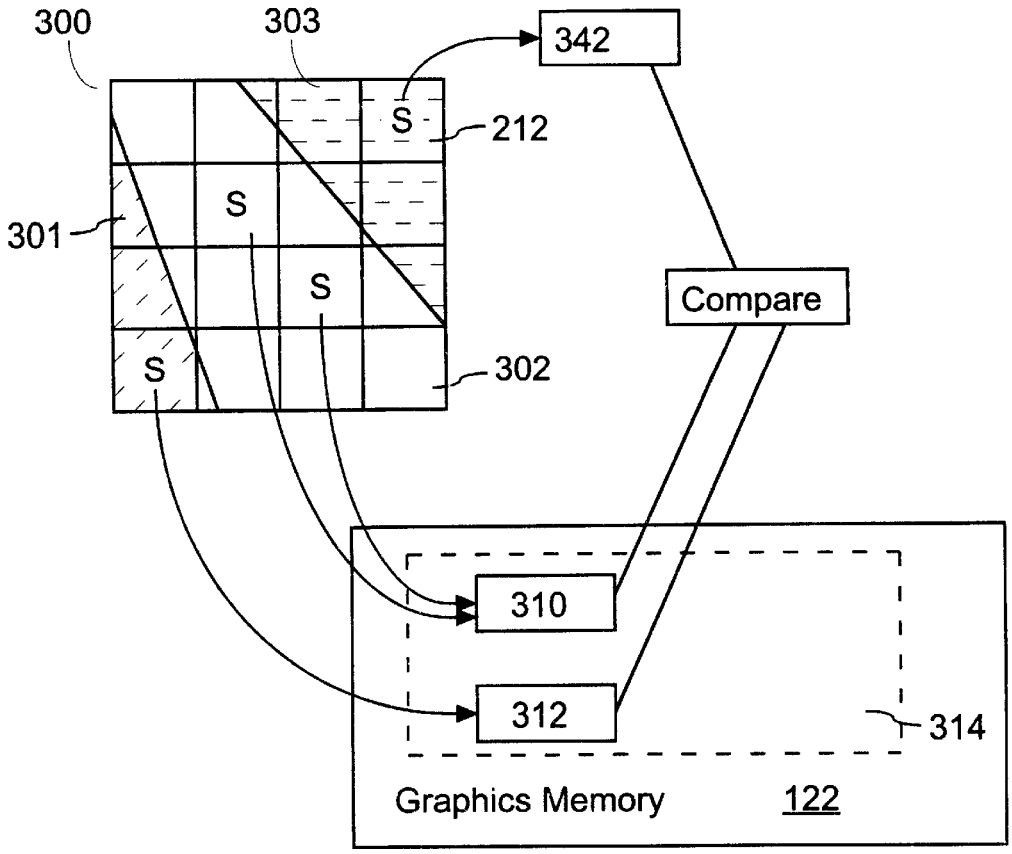
FIGS. 4A and 4B represents data structures and operations associated with merging two fragments and storing a resulting fragment in a pixel memory.

FIG. 4A illustrates an exemplary case in which, during the rendering of an image, a third fragment 303 is generated for a pixel that previously had just two visible fragments 301, 302. The third fragment 303 has an associated fragment value 342 and furthermore may be associated with a different set of the subpixel samples than the previously established fragments. For the purposes of this example, it is assumed that pixel memory 314 has room for just two fragments. Thus, when the new, third fragment is introduced, the third fragment must be processed by:

a) throwing out the new fragment;

b) replacing one of the previously stored fragment values with the new fragment value;

c) combining (i.e., merging or blending) the new fragment with one of the previously stored fragments; or d) combining the new fragment with both of the previously stored fragments.

Figure 4B:
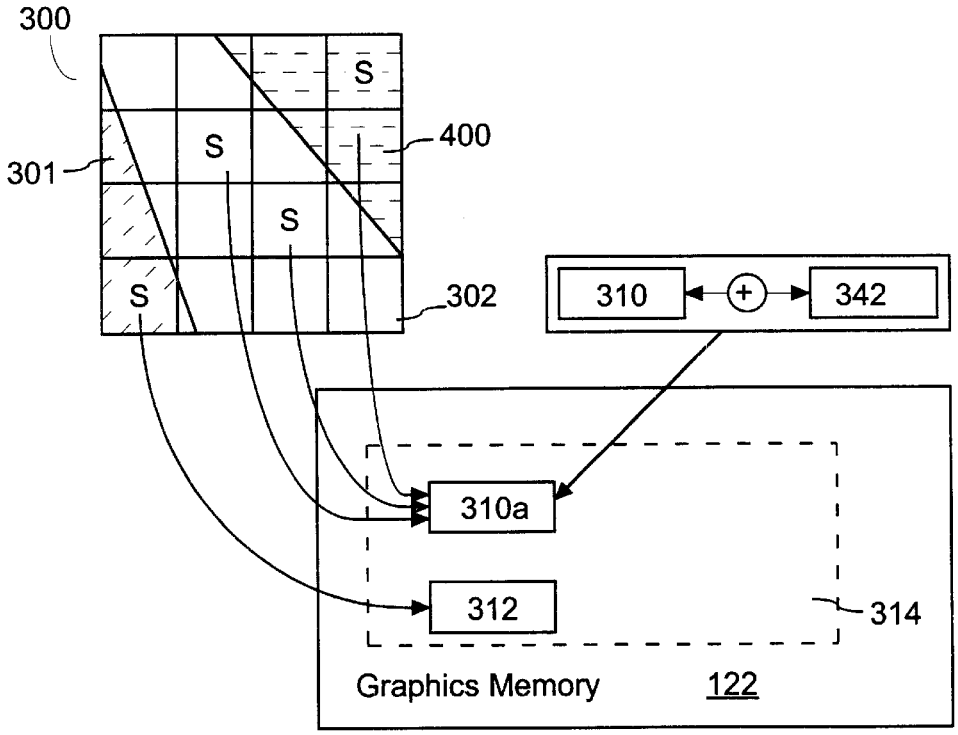

FIG. 4B represents case (c), in which one of the previously stored fragments is combined with the new fragment. The plus sign ("+") in FIG. 4B represents a blending of the two fragment tuples 310, 342. Various ways to handle the third fragment and its fragment value are described in more detail below.

Subpixel Z Values

Accurate treatment of subpixel Z values is in some ways more important than the accuracy of subpixel color values because small errors in Z values can lead to dramatically different pixel colors due to errors in occlusion calculations. Moreover, when rendering images it is common to have interpenetrating objects and fragments with overlapping Z ranges. Any technique that tries to reduce the storage required by Z entries has to pay special attention to various cases of interpenetrating and adjacent objects.

There are several possibilities for a more compact subpixel Z representation:

1. Single Z at pixel center.

This has the advantage of simplicity, but provides the least information. Like other approaches that rely on one value, it is impossible to antialias interpenetrating surfaces based on a single value. Even worse, for a fragment that does not cover the pixel center, the Z value associated with the fragment can be totally outside of its actual Z range. In the image shown in FIG. 5A, where fragment B would have a lower Z value at the pixel center than fragment A if each fragment were extended to the pixel center, this will lead to fragment B being visible and fragment A not being visible, even though the reverse is true.

2. $Z_{min}$ and $Z_{max}$.

In the original A-buffer paper a $Z_{max}$ and a $Z_{min}$ are used. These are used to estimate blending assuming the surfaces' slopes have opposite signs and the surfaces are interpenetrating. However, this case cannot be distinguished from FIG. 5B, since no information about the slopes are known. In this example, A and B should not be blended roughly equally, because fragment A completely obscures fragment B.

3. Fragment subpixel Z average, or Centroid adjust.

Figure 5A:
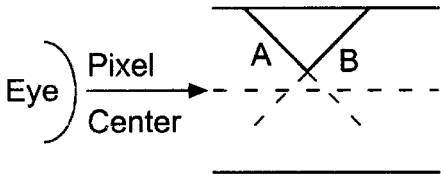
FIGS. 5A, 5B, 5C and 5D illustrate four potential Z-depth relationships of a pair of fragments.
Figure 5B:
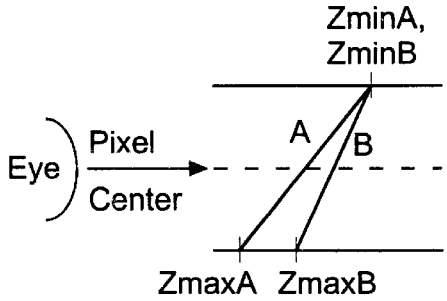
Figure 5C:
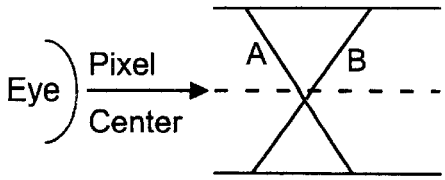

One way to improve the accuracy in cases like the one shown in FIG. 5A is to define each fragment's Z value to be the average Z value (or centroid) of the sample points covered by the fragment. This works in cases like the upper left example, but it still fails in others. Also, because it does not have any slope information, cases like the one shown in FIG. 5C will still not antialias. Instead the pixel will snap from fragment A's color to fragment B's color as B moves toward the viewer.

4. Zdx and Zdy slopes.

Figure 6:
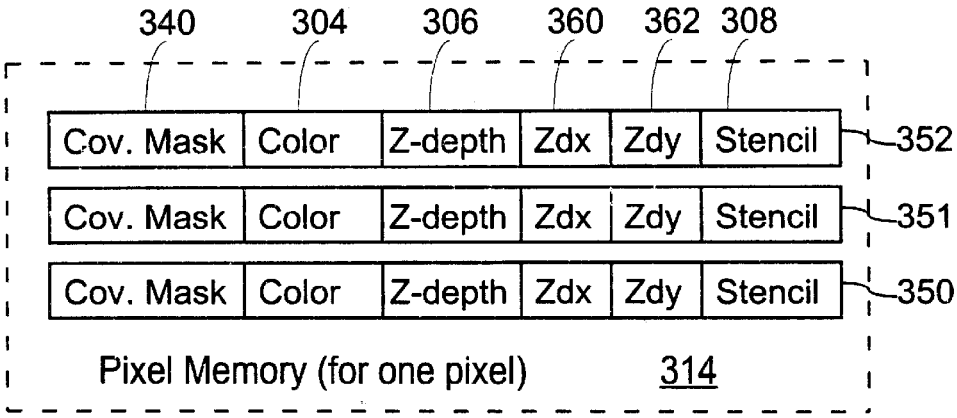
FIG. 6 illustrates a pixel memory storing fragment tuples that include Z gradient parameters for each stored fragment tuple.

As can be seen by the previous approaches, having complete subpixel Z information is crucial to proper rendering of many subpixel situations. X and Y slope information in combination with Z specified at the pixel center can be used to regenerate individual subpixel Z values accurately. FIG. 6 shows a pixel memory 314 having fragments tuples 350, 351, 352 that include Z slope (Zdx and Zdy) fields 360, 362, as well as the coverage mask 340, color 304, Z-depth 306 and stencil fields 308 described above.

Order-Independent Transparency

Traditional implementations of supersampling do not support transparency unless objects are sorted before rendering. Even with triangle sorting, interpenetrating transparent fragments are not handled correctly. The A-buffer algorithm provides antialiasing and order-independent transparency at the same time, but does not correctly handle interpenetrating opaque or transparent surfaces correctly. It also requires that all polygon fragments that can affect a pixel's color be kept until the drawing of the frame is complete. Only polygon fragments that are completely occluded by an opaque fragment may be deleted. Thus, in the worst case with many transparent objects, the A-buffer algorithm may require a potentially unbounded amount of memory for each pixel.

Two high-end graphics systems, the Megatek Discovery system (Megatek) and the Sogitec AZtec system (chauvin94), both implement versions of the A-buffer algorithm. Neither of these systems use Z gradients. The Megatek Discovery system maintains fragment lists of up to twenty-three fragments per pixel (Pinz). In practice the Megatek implementation never merges fragments. Fragments can fall off fragment lists if they exceed the maximum list length. The Sogitec AZtec system merges fragments if they have the same object tag, their Z values differ by at most a predetermined value, they are non-overlapping, and they have colors that differ by at most a predetermined value. It also merges the last two fragments in a list if it runs out of per-pixel storage.

$Z^3$ Fragment Merge Method

The present invention uses a fragment merge method that takes into account the Z depth of each fragment at each subpixel position, using low-cost hardware and providing order-independent transparency. Sparse supersampling is used. As described above, subpixels are grouped into fragments. However, when using the present invention, each fragment has a Zdx and Zdy slope value, in addition to a center referenced Z-depth value. Each slope value is preferably represented as a one byte floating-point value.

Each pixel is allocated a small fixed amount of memory, but a large number of sample points are stored in a coverage mask for each pixel fragment. As will be described in more detail below, if the visible complexity of the pixel (i.e., the number of fragments generated for the pixel) exceeds the storage space available for the pixel, fragments having the closest Z values are merged until the number of fragments stored is equal to the fragment storage capacity of the pixel. The fragment merge method combines fragments from the same surface without leading to artifacts.

The fragment representation and merge method of the present invention provides superior image quality compared to sparse supersampling methods that use eight samples per pixel, while using storage for only three fragments. This technique also makes the use of large numbers of samples (e.g., sixteen) feasible in inexpensive hardware. The present invention is simple to implement because it uses a small fixed number of samples per pixel. Like traditional supersampling techniques it properly antialiases opaque interpenetrating objects. However, it also provides order-independent transparency and antialiasing of interpenetrating transparent objects. The present invention provides order-independent transparency even if many transparent surfaces are present, albeit at a cost of slightly more memory.

Referring to FIG. 6, each pixel is preferably represented by a maximum of three fragment tuples 350, 351, 352. Each fragment tuple includes a color value 304, Z-depth value, 306, Zdx and Zdy values 360, 362, and an m-bit coverage mask 340, and an s-bit stencil 308. The m-bit coverage mask 340 for each fragment indicates which of the m sample points in the pixel are covered by the fragment. The fragment color value is the average of the color values at the covered sample points. The Z value for the fragment is specified at the center of the pixel, and the two gradient values 360, 362 are used to determine the Z-depth value at the subpixel sample positions.

The size of the pixel memory for each pixel, measured in number of bits, is $k\times(m+c+z+2g+s)$, where m is the number of subpixel sample points per pixel, c is the number of bits used to store a color value for one fragment, z is the number of bits used to store a Z-depth value, g is the number of bits used to store each Z gradient value, and s is the number of bits used in the stencil value for each fragment.

The Z gradients do not need to be extremely accurate to result in correct results in most circumstances. For example, for 24-bit integer Z value, 8-bit Z gradient values are sufficient to capture the whole range of possible Z gradients. An 8-bit Z gradient in a floating-point format can consist of a sign bit, a 5-bit exponent, and 3-bit mantissa. These 9 bits are stored in 8 bits utilizing a hidden MSB (most significant bit) mantissa bit, as in the IEEE floating point standard, since the MSB of a floating mantissa is always 1 unless the whole number is zero, which is denoted by a zero exponent. The 5-bit exponent can cover the entire range of the 24-bit fixed point Z value, plus additional fractional values.

A three-bit mantissa provides more than enough precision in the vast majority of cases where the Z gradient is needed. If the per fragment Z-value is stored as a floating point fornat, it is usually done to represent a Z value with a slightly larger range in a more compact format. In this case a slope exponent is more likely to be about 6 bits, and the Z range could also include some fractional values by using a biased exponent. This still leaves 2 bits for the mantissa and one for the sip.

Because the slopes have such small mantissas, they can easily be converted to fixed point Z slopes by small width shifters. In addition, all the computations required to compute Z-depth at each of the subpixel sample points can be accomplished using a relatively simple shift and add circuit, because the "pixel distance" between the center of the pixel and each of the subpixel sample points can be expressed as a fraction having a denominator that is a power of two and a numerator that is a small integer (generally equal to less than half of the denominator). Thus, computation of the Z-depth at any subpixel sample position is accomplished by:

A) computing the Zdx contribution
   - A1) right shifting Zdx gradient by $\mathrm{Log}_2$(denominator) bits
   - A2) adding the result to itself "numerator-1" times using a small number of adder circuits, to produce the Zdx contribution B) computing the Zdy contribution, using the same technique as for Zdx; and C) summing Z and the Zdx and Zdy contributions, once again using simple carry-save adders.

The computation of Z at the various subpixel sample positions requires much less hardware than storing the Z value for each subpixel sample and providing adequate read/write bandwidth for the tens of millions of subpixel sample points on a screen.

Unfortunately, there are not always a small fixed number of visible fragments per pixel, and in some cases there are more fragment entries than storage locations. This is particularly true; when there are a relatively large number of sample points in comparison to the number of available fragments, or when transparent objects are being rendered. In the worst opaque case, each of the eight sample points in FIG. 2*b* might be on a different fragment. If the system provides storage for only three fragments, there would be almost three times as much information as there is storage space. In the worst transparent case, the visible transparent depth complexity is virtually unbounded. Each transparent surface could also be fractured into many subpixel-sized fragments.

In general, if we have more fragments than we have locations for fragment storage, some information will be lost and this can lead to artifacts. The present invention attempts to minimize the information lost as well as the possible artifacts produced. The methodology of the present invention is complicated by the fact that fragment merge decisions must be made as the scene is being rendered, without any information about what future rendering operations may do.

In general, it is a premise of the present invention that merging fragments that are very close in their Z values is preferable to merging fragments with substantially different Z values. This combines fragments that are part of the same surface, but have been broken into multiple fragments by tesselation. Similarly, combining two transparent surfaces that are very close in Z value reduces the visible transparent depth complexity and in most cases results in no difference in pixel color.

Figure 7:
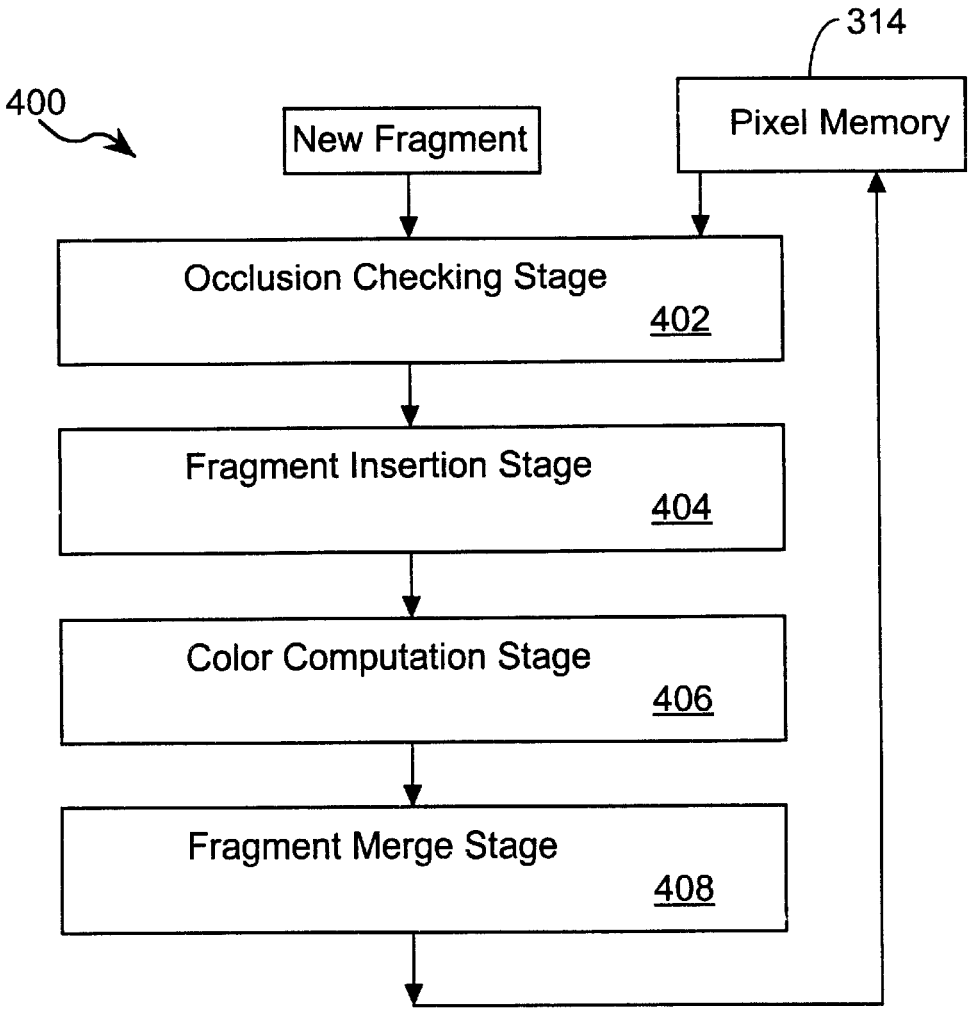
FIG. 7 illustrates a fragment processing pipeline.

There are four main steps that are taken when a new fragment "arrives at a pixel" (i.e., is presented to the graphics engine for storage). The steps are performed by a fragment processing pipeline 400, shown in FIG. 7. Existing fragments are stored in frame buffer memory, sorted based on their center Z value. When a new fragment arrives, the existing fragments are read in starting with the closest fragment. The four new fragment processing pipeline stages are: (A) occlusion check stage 402 (which invalidates fragments completely occluded by new fragment), (B) fragment insertion stage 404 (which inserts new a fragment in the fragment pipeline), (C) pixel color computation stage 406, and (D) fragment compression stage 408. These fragment processing stages, and the corresponding image data processing steps performed by those stages, are described in more detail next.

Figure 8A:
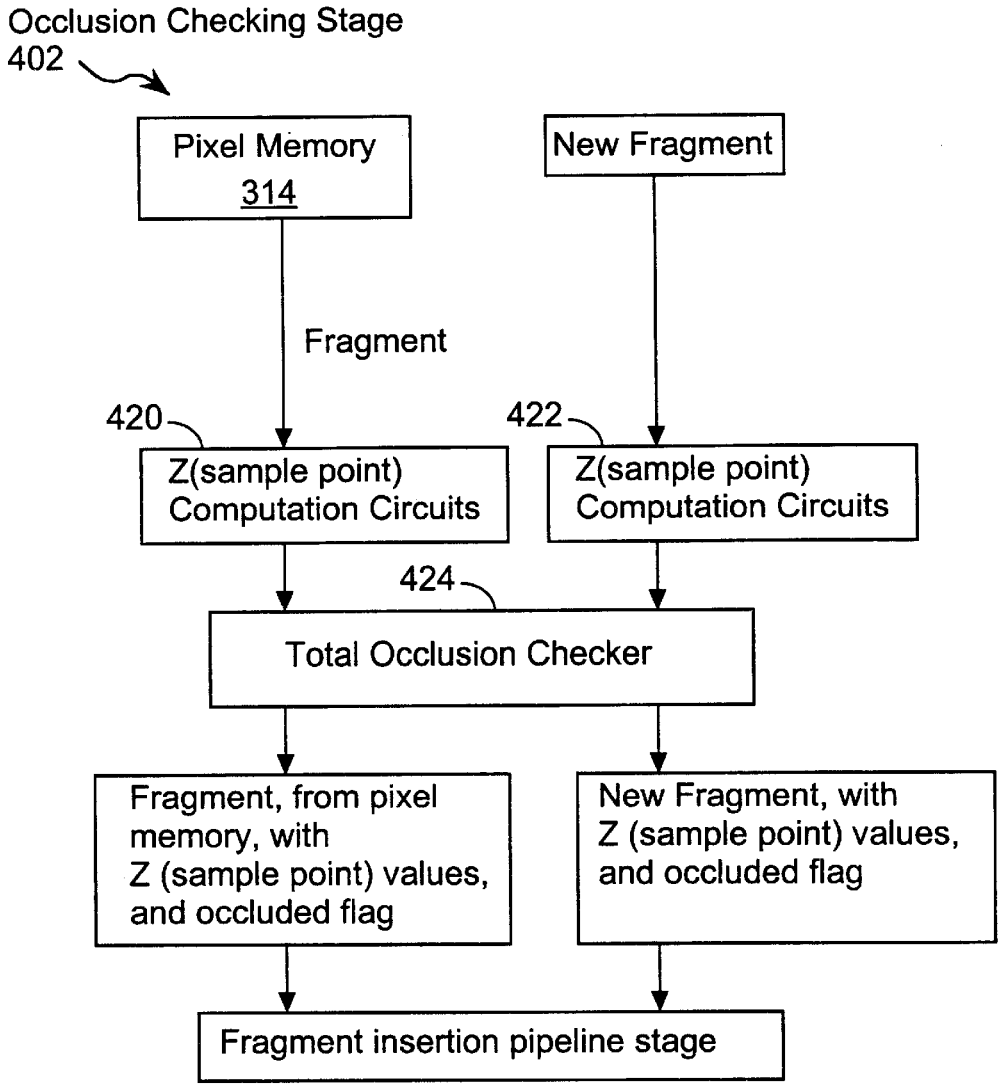
FIGS. 8A, 8B, 8C and 8D are block diagrams of successive stages of the fragment processing pipeline.
Figure 8B:
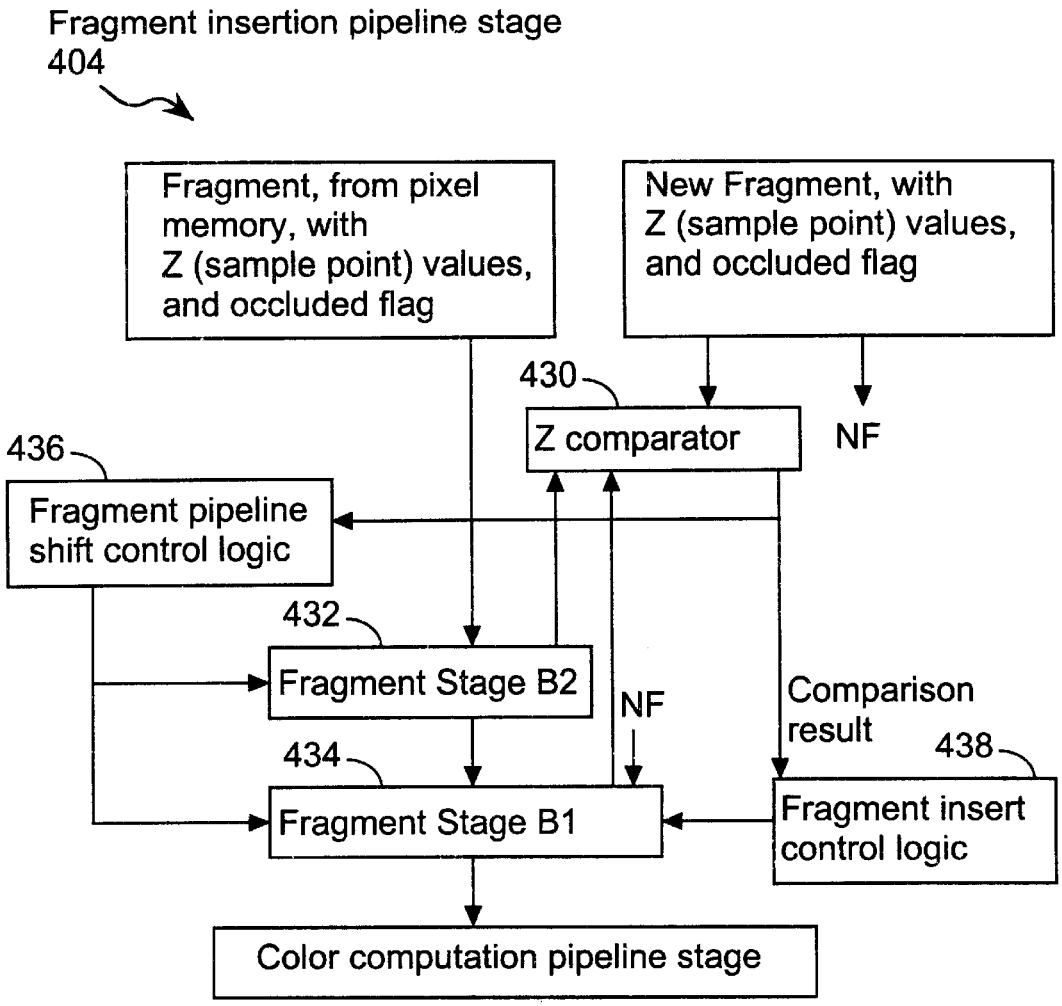

Referring to FIG. 8A, in the Occlusion Check stage 402 of the fragment processing pipeline, the sample points that are covered by the new fragment are checked to determine whether they occlude or are occluded by any stored fragments. This is done by computing the Z value for each subpixel sample position in the fragment read from the pixel memory, as well as for each subpixel sample position in the new fragment using Z coordinate computation circuits 420, 422. These circuits compute the Z-depth for each subpixel position from the center Z value and the Zdx and Zdy slopes, using adders and a bit shifter for each subpixel position. Then a comparator 424 compares the Z-depth value for each subpixel position of the new fragment with the Z-depth value for each subpixel position of fragment from the pixel memory. If the comparator determines that either fragment is completely occluded by the other, then that fragment is marked by an occluded flag; otherwise an occluded flag for each fragment is cleared. If a stored fragment is completely occluded by the new fragment, the fragment is invalidated by setting its occluded flag, so that its storage can be re-used.

When any subpixel sample positions of either fragment are occluded by the other, the comparator 424 clears the corresponding coverage mask bits. Thus, when a fragment is determined to be totally occluded by the other, all the bits in the occluded fragment's coverage mask are cleared by the comparator 424.

In the Fragment Insertion stage 404 of the fragment processing pipeline, if any sample points of the new fragment pass the occlusion test, the new fragment is inserted in the pipeline of existing fragments in the proper place based on its center weighted Z value. This is preferably done by using a comparator 430 to compare the new fragment's center referenced Z value with the Z value for fragments in two successive stages 432, 434 of the fragment pipeline. If the new fragment Z value is larger than the Z value of the fragment in the first stage but less than the Z value of the fragment in the second stage, at the next pipeline shift clock cycle a pipeline shift control circuit 436 and fragment insert control circuit load the new fragment into the first stage 434, while preventing the second fragment in stage 432 and those behind from advancing.

In the Pixel Color Computation stage 406 of the pipeline, the pixel color is computed before any compression required by the addition of the new fragment. Thus the pixel color is based on all the information in the existing fragments and the new fragment. Details of the pixel color computation including computation of the swap vector are described below.

In the Fragment Compression stage of the pipeline, if there are more fragments than storage locations, two of the fragments are merged with another. This is described in more detail below.

Pixel Color Computation Stage of Pipeline

Because the fragments within a pixel are sorted in depth order, we can usually compute the color of each pixel by alpha blending whole fragments. A box filter is then applied to produce the final pixel color, although the present invention can be implemented using complex filters.

Figure 5D:
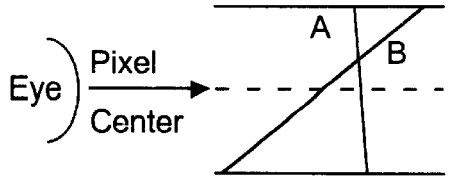

Unfortunately when transparent fragments overlap in their Z ranges with other fragments (which may or may not be transparent), computing the final pixel color based on the sorting implied by the center-referenced Z values can create erroneous results. Consider the situation shown in FIG. 5D, in which transparent fragment A is actually partially in front of opaque fragment B, even though its center-referenced Z value is behind it. If A is processed first, the opaque fragment B will completely obscure fragment A instead of blending with the portion of A in front of fragment B.

Figure 8C:
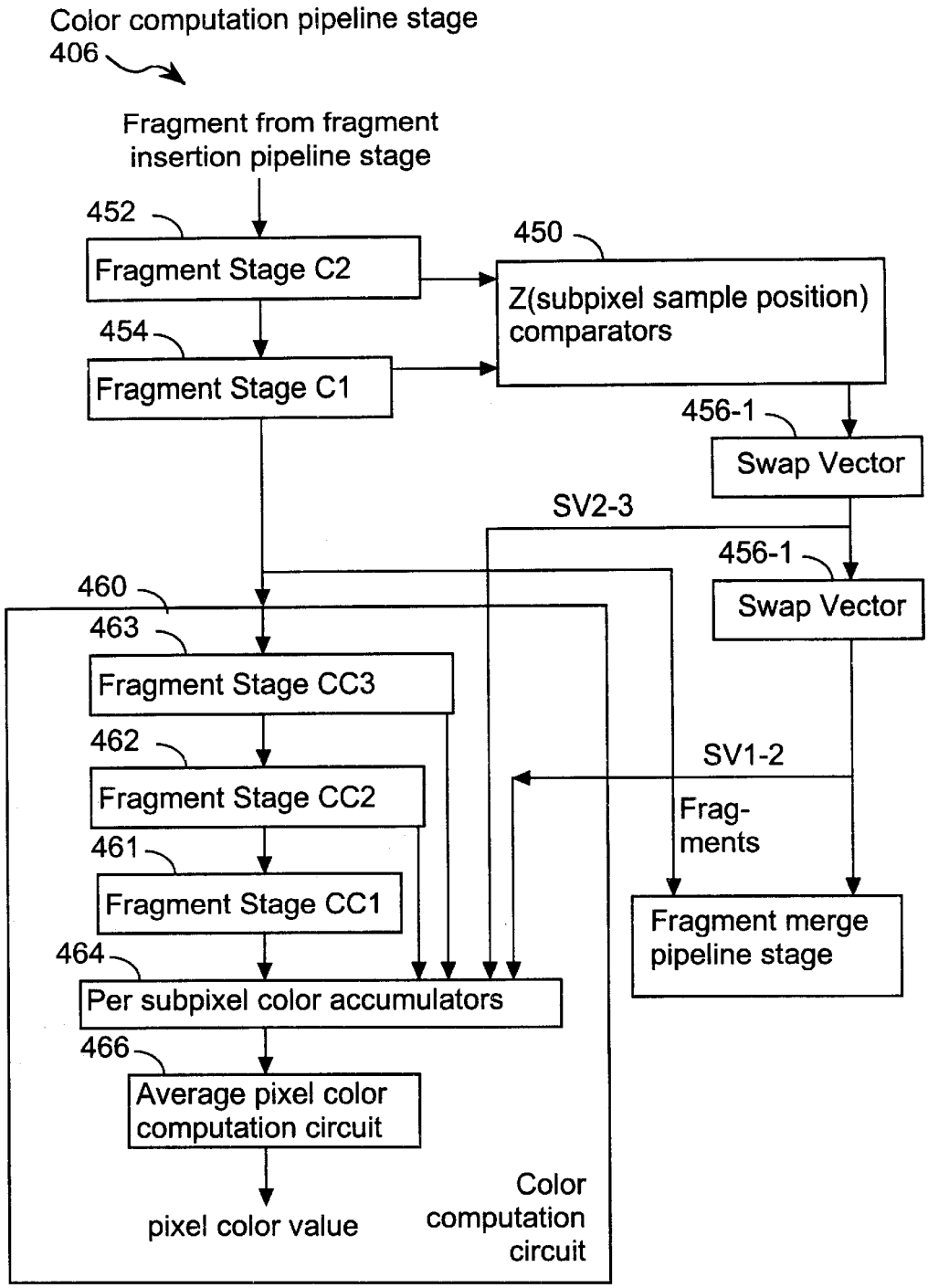

In order to handle interpenetrating fragment cases properly, a copy of the fragment color is kept with the per-sample point Z value in the pipeline. Referring to FIG. 8C, before computing the color at each sample point, an array of comparators 450 are used to compare the per-sample point Z values in adjacent stages 452, 454 of the pipeline. The comparators 450 are inactive for subpixel sample positions that are not covered by both fragments, as indicated by the coverage masks of the fragments. That is, the comparators 450 will not cause reordering of subpixel sample position values for any subpixel sample position that is not covered by both fragments.

If the front-to-back order of the subpixel samples at any particular subpixel sample positions are wrong, a corresponding bit is set in a swap vector 456 that is associated with the pair of fragments whose Z values are being compared. If no bits are set in the swap vector 456, then all the subpixel fragments in the two fragments are already in proper Z value order. Otherwise, the subpixel samples corresponding to the set swap vector bits will need to be reordered during computation of the color of the pixel. The same re-ordering is also needed if the two fragments are to be merged by the fragment merge pipeline stage. Therefore the swap vector 456 is transmitted to both the color computation circuit 460 and the fragment merge pipeline stage 470.

In the color computation circuit 460, the fragments are shifted into a set of pipeline stages CC3, (463), CC2 (462) and CC1 (462) and then into a per subpixel color accumulator 464. A set of two corresponding. swap vectors SV1-2 and SV2-3 are also provided to the subpixel color accumulator, including one swap vector SV1-2 for re-ordering subpixels between the fragments in stages CC1 and CC2, and a second swap vector SV2-3 for reordering subpixels between the fragments in stages CC2 and CC3.

The per subpixel color accumulator 464 includes N color computation circuits, one for each subpixel sample position. Each subpixel accumulator receives a coverage mask value and color value for a subpixel sample of a fragment stored in pipeline stage 461, or 462. In particular, each subpixel accumulator includes a multiplexor for selecting which subpixel color value to use as its back value (see equations below). The front value is always the one currently stored in the accumulator. The back value is normally the subpixel fragment value from stage CC2, unless swap vector SV2-3 for that subpixel sample is set, in which case it uses the subpixel fragment value from stage CC3 as the back value. However, if the swap vector SV1-2 bit is set, the back value multiplexor selects the fragment value from CC1 as the back fragment value input. It is assumed that both swap vectors will not be set at the same time; but if they are, the subpixel fragment value from CC1 is used, and the corresponding bit in the SV2-3 is cleared to prevent double counting of one subpixel fragment value and skipping another one.

If the received coverage mask value indicates that the fragment in the pipeline stage 461 does not cover the subpixel, then the contents of the subpixel color accumulator are left unchanged. If the received coverage mask value indicates that the fragment in pipeline stage 461 covers the subpixel, then the subpixel color accumulator merges the received color information with the color information, if any, previously received for that subpixel, as follows:

$$\alpha_{accumulator} = \alpha_{front} + \frac{(1-\alpha_{front})\times\alpha_{back}}{255}$$

$$C_{accumulator} = C_{front}\times\alpha_{front} + \frac{C_{back}\times\alpha_{back}\times(1-\alpha_{front})}{255}$$

for each of the color channels R, G, and B.

As a result of the subpixel reordering associated with the swap vector, the graphics engine correctly reorders all sample points where one fragment interpenetrates an adjacent fragment. This reordering is needed in order to property handle the color computation of pixels having at least one partially transparent fragment.

It is noted that the fragment processing pipeline does not correctly handle arbitrary interpenetration, such as one perpendicular fragment interpenetrating many parallel fragments. However, such cases are rare, and moreover the error in such cases is not large because of the many surfaces viewed in series and the small coverage of the perpendicular fragment.

After all the fragments for a pixel have been processed by the per pixel color accumulator 464, an average pixel color calculator 466 sums the colors from all the sample points and divides that result by the number of samples per pixel to generate the color value (R, B, G and Alpha) for the pixel. This pixel color value is generated using all the available fragment information, even if the number of fragments in the pipeline exceeds the fragment memory storage available in the pixel memory. As a result, the pixel color value generated by the pixel color computation stage 406 may be more accurate than the color value that can be generated after the pixel's fragments have been processed by the fragment compression stage 408 of the pipeline.

Fragment Compression Stage of Pipeline

Figure 8D:
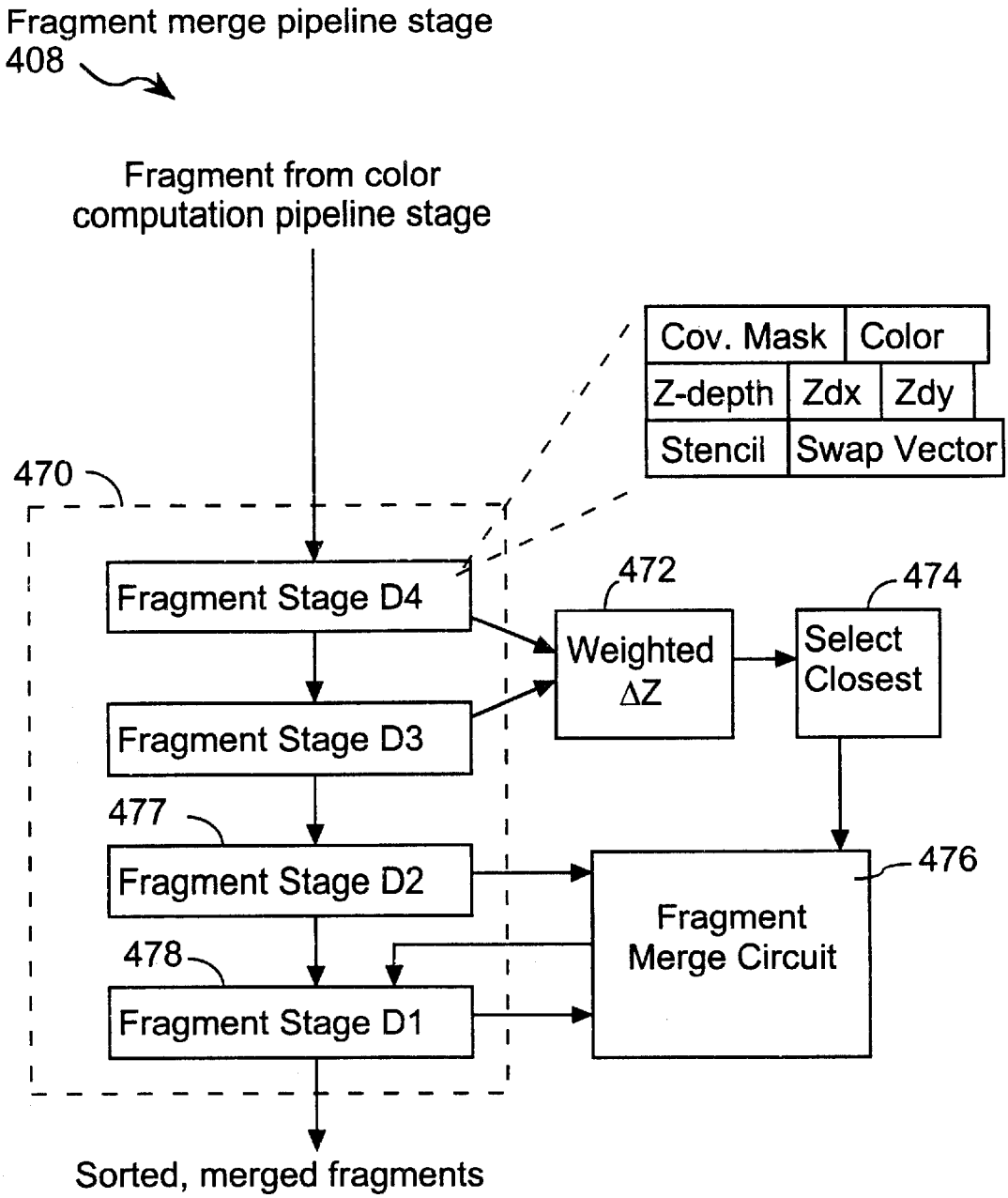

Fragment compression only takes place when the number of fragments exceeds the preset limit k. Because the fragments are sorted in order of increasing center Z values, we know that the two closest fragments (in terms of their center Z values) are adjacent to each other in the pipeline. Although differences between center Z values and per sample point Z values are significant for occlusion and color calculations, we have found that center Z values are adequate for merging of fragments. Referring to FIG. 8D, as the fragments pass through the pipeline 470, they pass by a subtractor circuit 472 that computes the difference in center Z values between the adjacent stages. A selector circuit 474 receives the Z difference values from the subtractor, determines which one of the k adjacent pairs of fragments out of the k+1 fragments are closest, and signals a fragment merge circuit 476 to merge the two fragments that are closest to each other.

Because merging may introduce errors, the fragment compression stage is designed to minimize the extent of these errors. In general, changes to fragments covering a small number of sample points result in smaller pixel errors than changes to fragments covering a large number of sample points. Also, the information content (in terms of the final pixel color) of a fragment entry covering many sample points is higher than that of an entry covering just one or a few sample points. For this reason we also weight the Z difference calculations by the minimum of the sample coverage counts of the two fragments. What this does is bias the selection towards the combining of small fragments that may be a little further apart rather than larger fragments that may be a little closer. We have found that this improves the final image quality.

To handle merging of interpenetrating transparent fragments correctly, the fragment combining stage 408 uses information that was saved during pixel color computation in the swap vector 456. There is a swap vector for each pair of fragments and it has a bit for each sample point. The swap vector bit is set when the order of a pair of fragments must be swapped during color computation of that sample point due to interpenetration of the fragments. After the swap vector has been computed on either side of a fragment, subsequent stages of the pipeline do not process the per sample-point Z information, which reduces the amount of circuitry used by those pipeline stages.

The center Z values of the two merging fragments are weighted averaged based on the number of sample points that they cover. Weighted averaging of gradients works in many situations, but does not work in situations where one of the fragments is being viewed edge-on such as the side of a cylinder. These fragments may have extremely large gradients (approaching the maximum Z value) that will still be extremely large after averaging, but cover much more of the pixel. Instead, for each of the incoming fragments, the fragment combining pipeline stage computes the absolute value of the Zdx and Zdy gradients (by setting the sign bit to zero), and then set the merged fragment's Zdx and Zdy gradients to those Zdx and Zdy gradients with the smallest magnitude. In other words, the Zdx and Zdy gradients are selected separately, each being the one with the smallest magnitude. The stencil of the fragment covering the most samples is copied to the combined fragment.

The merging of the adjacent fragment pair is complicated by transparency. When both fragments are opaque, their color contents are simply combined with weighted averaging based on the number of sample points each one covers. When one or both of the fragments are transparent, the calculation of merged fragment color is performed on a per sample point basis, using the swap vector to get the per sample point ordering correct.

The fragment merge circuit 476 includes N color computation circuits, one for each subpixel sample position. Each subpixel color computation circuit receives a coverage mask value and color value for a corresponding subpixel in each of the two final fragment pipeline stages 477, 478. It also receives the corresponding swap vector bit, which is used to determine which of the .subpixels is in front and which is in back. In particular, if the swap vector bit is not set (i.e., no swapping is required, then the subpixel from the last fragment pipeline stage 478 is in front; otherwise the subpixel from the next to last fragment pipeline stage 477 is in front.

The following equations describe the color computations performed at each sample point when merging two fragments, assuming 8-bit alpha and color channels. Sample points uncovered by either fragment return zero. Sample points covered by only one fragment return the alpha and each color channel multiplied by the alpha of that fragment. For sample points covered by both fragments, the following computations are made independently for each subpixel sample point using the swap vector to determine which fragment is in front and which is in back.

$$\alpha_{sample} = \alpha_{front} + \frac{(1-\alpha_{front})\times\alpha_{back}}{255}$$

$$C_{sample} = C_{front}\times\alpha_{front} + \frac{C_{back}\times\alpha_{back}\times(1-\alpha_{front})}{255}$$

where C is each of the color channels R, G, and B. The fragment merge circuitry computes the transparency and reflected light for each of the colors (multiplied by 255) for each sample point, in accordance with the equations shown above. Then the alphas and color channels from each sample point are summed. The number of sample points covered by the merged fragment $cnt_m$ is computed by logically OR'ing together the two coverage masks and counting the number of covered subpixel samples in the resulting coverage mask. Then the final merged fragment color and alpha values for the merged fragment are computed as follows:

$$\alpha_{merged} = \frac{\sum \alpha_{sample}}{cnt_m}$$

$$C_{merged} = \frac{\sum C_{sample}}{\alpha_{merged}\times cnt_m}$$

for each of the color channels R, G, and B. In alternate embodiments, various filters may be applied to the subpixel color and alpha values while combining those values to generate the final merged color and alpha values for the merged fragment.

Accurately rendering transparent scenes requires the use of more fragments per pixel than rendering schemes without transparent objects. In order to keep antialiasing noise errors to an acceptable level while rendering scenes having transparent objects, it has been found that four fragments per pixel, and sixteen subpixel samples (with a 16×16 sampling matrix) provides reasonable aliasing error reduction. To provide 16X sparse supersampling with storage for four fragments per pixel requires about 50 bytes of storage per pixel. Hence a 1280×1024 resolution screen would require about 64 MB of frame buffer memory (not including textures).

Alternate Embodiments

When rendering images that only include opaque objects (i.e., no transparent objects), the swap vectors are not needed. Thus, an implementation of the invention that does not use transparency information would have considerably simpler color computation and merge logic.

It is to be understood that the above described embodiments are simply illustrative of the principles of the invention. Various other modifications and changes may be made by those skilled in the art which will embody the principles of the invention, and fall within the spirit and the scope thereof.

What is claimed is:

1. Image processing apparatus, comprising:

pixel memory storing up to a predetermined number of fragment tuples, each stored fragment tuple being associated with a fragment that is visible in the pixel; each fragment tuple including a color value, a center Z (depth) value, and a pair of Z gradient values;

a pipeline processing circuit for processing a new fragment tuple representing a fragment added to the pixel, the pipeline processing circuit including a sequence of pipeline stage circuits, the pipeline stage circuits including:

a fragment ordering pipeline stage for ordering the new fragment tuple and the fragment tuples stored in the pixel memory so as to generate a sequence of fragment tuples ordered with respect to Z value;

a subpixel ordering pipeline stage for determining if successive fragments in the sequence of fragments are out of order with respect to Z value at any of a predefined set of subpixel positions, including:

subpixel Z value generation circuitry for determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and subpixel Z value comparison circuitry for comparing the determined Z values and generating swap values indicating whether the fragments are out of order with respect to Z value at each of the predefined subpixel sample positions; and a merge pipeline stage that uses the swap values to produce a modified sequence of fragment tuples, the merge pipeline stage merging two of the fragment tuples in the modified sequence of fragment tuples, when the sequence of fragment tuples includes more fragment tuples than said predetermined number, so as to generate a merged fragment tuple, the merge pipeline including subpixel merge circuitry for merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values.

2. The image processing apparatus of claim 1, wherein the merge pipeline stage includes a Z difference circuit for determining a Z difference value for each pair of neighboring fragment tuples in the modified sequence of fragment tuples, a selection circuit for selecting a closest pair of successive fragment tuples in the modified sequence of fragment tuples based on the Z difference values generated by the Z difference circuit, and a fragment merge circuit for merging the pair of selected fragment tuples to generate the merged fragment tuple.

3. The image processing apparatus of claim 2, wherein the fragment merge circuit generates a merged color value and merged transparency value for each of a plurality of subpixel sample positions within the pixel, and then combines the generated merged color values to generate a color value for the merged fragment tuple and combines the generated merged transparency values to generate a transparency value for the merged fragment tuple.

4. The image processing apparatus of claim 2, wherein the fragment merge circuit generates a Z value for the merged fragment tuple by averaging weighted Z values, the weighted Z values corresponding to the Z value of each of the neighboring fragment tuples multiplied by a number of subpixel sample positions covered by the corresponding fragment.

5. The image processing apparatus of claim 2, wherein the two fragment tuples merged have associated therewith first Zdx and first Zdy gradient values and second Zdx and second Zdy gradient values; and the fragment merge circuit generates a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

6. The image processing apparatus of claim 1, wherein the pipeline includes pixel color computation circuitry for generating a pixel color value, including:

subpixel color computation circuitry for generating a merged color value for each of the predefined subpixel sample positions by merging, for each of the predefined subpixel sample positions, color values from all the fragment tuples in the sequence of fragment tuples, the color values being merged at each subpixel sample position in an order specified by the corresponding swap values; and pixel color computation circuitry for combining the merged color values for all the predefined subpixel sample positions to generate the pixel color value.

7. The image processing apparatus of claim 1, wherein the merge pipeline stage includes a fragment merge circuit for merging the two fragment tuples to generate the merged fragment tuple, the fragment merge circuit configured to generate a Z value for the merged fragment tuple by averaging weighted Z values, the weighted Z values corresponding to the Z value of each of the two fragment tuples multiplied by a number of subpixel sample positions covered by the corresponding fragment.

8. The image processing apparatus of claim 1, wherein the two fragment tuples merged have associated therewith first Zdx and first Zdy gradient values and second Zdx and second Zdy gradient values; and the merge pipeline stage includes a fragment merge circuit for merging the two fragment tuples to generate the merged fragment tuple, the fragment merge circuit configured to generate a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

9. A method of rendering an image, comprising:

for each pixel of the image, storing up to a predetermined number of fragment tuples, each stored fragment tuple being associated with a fragment that is visible in the pixel; each fragment tuple including a color value, a center Z (depth) value, and a pair of Z gradient values;

processing a new fragment tuple representing a fragment added to the pixel, including:

ordering the new fragment tuple and the fragment tuples stored for the pixel so as to generate a sequence of fragment tuples ordered with respect to Z value;

determining if successive fragments in the sequence of fragments are out of order with respect to Z value at any of a predefined set of subpixel positions, including:

determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and comparing the determined Z values, and generating swap values indicating whether the fragments are out of order with respect to Z value at each of the predefined subpixel sample positions, the swap values being used to produce a modified sequence of fragment tuples; and merging two of the fragment tuples in the modified sequence of fragment tuples, when the sequence of fragment tuples includes more fragment tuples than said predetermined number, so as to generate a merged fragment tuple, including merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values.

10. The method of claim 9, the fragment merging step includes determining a Z difference value for each pair of neighboring fragment tuples in the modified sequence of fragment tuples, selecting a closest pair of successive fragment tuples in the modified sequence of fragment tuples based on the Z difference values, and merging the pair of selected fragment tuples to generate the merged fragment tuple.

11. The method of claim 10, wherein the fragment merging step generates a merged color value and merged transparency value for each of a plurality of subpixel sample positions within the pixel, and then combines the generated merged color values to generate a color value for the merged fragment tuple and combines the generated merged transparency values to generate a transparency value for the merged fragment tuple.

12. The method of claim 10, wherein the fragment merging step generates a Z value for the merged fragment tuple by averaging weighted Z values, the weighted Z values corresponding to the Z value of each of the neighboring fragment tuples multiplied by a number of subpixel sample positions covered by the corresponding fragment.

13. The method of claim 10, wherein the two fragment tuples merged have associated therewith first Zdx and first Zdy gradient values and second Zdx and second Zdy gradient values; and the fragment merging step generates a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

14. The method of claim 9, including generating a merged color value for each of the predefined subpixel sample positions by merging, for each of the predefined subpixel sample positions, color values from all the fragment tuples in the sequence of fragment tuples, the color values being merged at each subpixel sample position in an order specified by the corresponding swap values; and combining the merged color values for all the predefined subpixel sample positions to generate a pixel color value.

15. The method of claim 9, wherein the fragment merging step generates a Z value for the merged fragment tuple by averaging weighted Z values, the weighted Z values corresponding to the Z value of each of the neighboring fragment tuples multiplied by a number of subpixel sample positions covered by the corresponding fragment.

16. The method of claim 9, wherein the two fragment tuples merged have associated therewith first Zdx and first Zdy gradient values and second Zdx and second Zdy gradient values; and the fragment merging step generates a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

17. Image processing apparatus, comprising:

pixel memory storing up to a predetermined number of fragment tuples, each stored fragment tuple being associated with a fragment that is visible in the pixel; each fragment tuple including a color value, a center Z (depth) value, and a pair of Z gradient values;

a pipeline processing circuit for processing a new fragment tuple representing a fragment added to the pixel, the pipeline processing circuit including a sequence of pipeline stage circuits, the pipeline stage circuits including:

a fragment ordering pipeline stage for ordering the new fragment tuple and the fragment tuples stored in the pixel memory so as to generate a sequence of fragment tuples ordered with respect to Z value;

a subpixel ordering pipeline stage for determining if successive fragments in the sequence of fragments are out of order with respect to Z value at any of a predefined set of subpixel positions, including:

subpixel Z value generation circuitry for determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and subpixel Z value comparison circuitry for comparing the determined Z values and generating swap values indicating whether the fragments are out of order with respect to Z value at each of the predefined subpixel sample positions, the swap values being used to produce a modified sequence of fragment tuples; and a merge pipeline stage merging two of the fragment tuples in the modified sequence of fragment tuples, when the sequence of fragment tuples includes more fragment tuples than said predetermined number, so as to generate a merged fragment tuple, the merge pipeline including subpixel merge circuitry for merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values, the merge pipeline stage including a Z difference circuit for determining a Z difference value for each pair of neighboring fragment tuples in the modified sequence of fragment tuples, a selection circuit for selecting two successive fragment tuples in the modified sequence of fragment tuples based on the Z difference values generated by the Z difference circuit, and a fragment merge circuit for merging the two selected fragment tuples to generate the merged fragment tuple, wherein the fragment merge circuit generates a merged color value and merged transparency value for each of a plurality of subpixel sample positions within the pixel, and then combines the generated merged color values to generate a color value for the merged fragment tuple and combines the generated merged transparency values to generate a transparency value for the merged fragment tuple, and wherein the fragment merge circuit further generates a Z value for the merged fragment tuple by averaging weighted Z values, the weighted Z values corresponding to the Z value of each of the neighboring fragment tuples multiplied by a number of subpixel sample positions covered by the corresponding fragment.

18. Image processing apparatus, comprising:

pixel memory storing up to a predetermined number of fragment tuples, each stored fragment tuple being associated with a fragment that is visible in the pixel; each fragment tuple including a color value, a center Z (depth) value, and a pair of Z gradient values;

a pipeline processing circuit for processing a new fragment tuple representing a fragment added to the pixel, the pipeline processing circuit including a sequence of pipeline stage circuits, the pipeline stage circuits including:

a fragment ordering pipeline stage for ordering the new fragment tuple and the fragment tuples stored in the pixel memory so as to generate a sequence of fragment tuples ordered with respect to Z value;

a subpixel ordering pipeline stage for determining if successive fragments in the sequence of fragments are out of order with respect to Z value at any of a predefined set of subpixel positions, including:

subpixel Z value generation circuitry for determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and subpixel Z value comparison circuitry for comparing the determined Z values and generating swap values indicating whether the fragments are out of order with respect to Z value at each of the predefined subpixel sample positions, the swap values being used to produce a modified sequence of fragment tuples; and a merge pipeline stage merging two of the fragment tuples in the modified sequence of fragment tuples, when the sequence of fragment tuples includes more fragment tuples than said predetermined number, so as to generate a merged fragment tuple, the merge pipeline including subpixel merge circuitry for merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values, the merge pipeline stage including a Z difference circuit for determining a Z difference value for each pair of neighboring fragment tuples in the modified sequence of fragment tuples, a selection circuit for selecting two successive fragment tuples in the modified sequence of fragment tuples based on the Z difference values generated by the Z difference circuit, and a fragment merge circuit for merging the two selected fragment tuples to generate the merged fragment tuple, the two selected fragment tuples merged having associated therewith first Zdx and first Zdy gradient values and second Zdx and second Zdy gradient values, wherein the fragment merge circuit generates a merged color value and merged transparency value for each of a plurality of subpixel sample positions within the pixel, and then combines the generated merged color values to generate a color value for the merged fragment tuple and combines the generated merged transparency values to generate a transparency value for the merged fragment tuple, and wherein the fragment merge circuit further generates a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

19. A method of rendering an image, comprising:

for each pixel of the image, storing up to a predetermined number of fragment tuples, each stored fragment tuple being associated with a fragment that is visible in the pixel; each fragment tuple including a color value, a center Z (depth) value, and a pair of Z gradient values;

processing a new fragment tuple representing a fragment added to the pixel, including:

ordering the new fragment tuple and the fragment tuples stored for the pixel so as to generate a sequence of fragment tuples ordered with respect to Z value;

determining if successive fragments in the sequence of fragments are out of order with respect to Z value at any of a predefined set of subpixel positions, including:

determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and comparing the determined Z values, and generating swap values indicating whether the fragments are out of order with respect to Z value at each of the predefined subpixel sample positions, the swap values being used to produce a modified sequence of fragment tuples; and merging two of the fragment tuples in the modified sequence of fragment tuples, when the sequence of fragment tuples includes more fragment tuples than said predetermined number, so as to generate a merged fragment tuple, including merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values, the merging step comprising determining a Z difference value for each pair of neighboring fragment tuples in the modified sequence of fragment tuples, selecting two successive fragment tuples in the modified sequence of fragment tuples based on the Z difference values, and merging the two selected fragment tuples to generate the merged fragment tuple, the merging step further comprising generating a merged color value and merged transparency value for each of a plurality of subpixel sample positions within the pixel, combining the generated merged color values to generate a color value for the merged fragment tuple, and combining the generated merged transparency values to generate a transparency value for the merged fragment tuple, the merging step additionally comprising generating a Z value for the merged fragment tuple by averaging weighted Z values, the weighted Z values corresponding to the Z value of each of the neighboring fragment tuples multiplied by a number of subpixel sample positions covered by the corresponding fragment.

20. A method of rendering an image, comprising:

for each pixel of the image, storing up to a predetermined number of fragment tuples, each stored fragment tuple being associated with a fragment that is visible in the pixel; each fragment tuple including a color value, a center Z (depth) value, and a pair of Z gradient values;

processing a new fragment tuple representing a fragment added to the pixel, including:

ordering the new fragment tuple and the fragment tuples stored for the pixel so as to generate a sequence of fragment tuples ordered with respect to Z value;

determining if successive fragments in the sequence of fragments are out of order with respect to Z value at any of a predefined set of subpixel positions, including:

determining a Z value for two successive fragments tuples in the sequence of fragment tuples at each subpixel sample position, if any, covered by both of the two fragments represented by the two fragment tuples, based on the center Z value and pair of Z gradient values for each of the two fragments tuples; and comparing the determined Z values, and generating swap values indicating whether the fragments are out of order with respect to Z value at each of the predefined subpixel sample positions, the swap values being used to produce a modified sequence of fragment tuples; and merging two of the fragment tuples in the modified sequence of fragment tuples, when the sequence of fragment tuples includes more fragment tuples than said predetermined number, so as to generate a merged fragment tuple, including merging color values for the two fragment tuples at each of the predefined subpixel sample positions, if any, that is covered by both of the two fragments represented by the two fragment tuples being merged, the color values being merged at each such subpixel sample position in an order specified by a corresponding one of the swap values, the merging step comprising determining a Z difference value for each pair of neighboring fragment tuples in the modified sequence of fragment tuples, selecting two successive fragment tuples in the modified sequence of fragment tuples based on the Z difference values, and merging the two selected fragment tuples to generate the merged fragment tuple, the two selected fragment tuples merged having associated therewith first Zdx and first Zdy gradient values and second Zdx and second Zdy gradient values, the merging step further comprising generating a merged color value and merged transparency value for each of a plurality of subpixel sample positions within the pixel, combining the generated merged color values to generate a color value for the merged fragment tuple, and combining the generated merged transparency values to generate a transparency value for the merged fragment tuple, the merging step additionally comprising generating a pair of Z gradient values for the merged fragment tuple by comparing absolute values of the first and second Zdx gradient values and selecting one of the first and second Zdx gradient values in accordance with the result of the comparison thereof, and by comparing absolute values of the first and second Zdy gradient values and selecting one of the first and second Zdy gradient values in accordance with the result of the comparison thereof.

* * * * *